United States Patent [19]

Sawyer

[11] 4,179,768

[45] Dec. 25, 1979

[54] VACUUM DUMPING ARRANGEMENT FOR A WET/DRY VACUUM CLEANER

[75] Inventor: Roderick Sawyer, Elkhart, Ind.

[73] Assignee: Aktiebolaget Electrolux, Stockholm, Sweden

[21] Appl. No.: 935,367

[22] Filed: Aug. 21, 1978

Related U.S. Application Data

[63] Continuation of Ser. No. 777,959, Mar. 16, 1977, abandoned.

[51] Int. Cl.[2] ..... A47L 7/00

[52] U.S. Cl. ..... 15/352; 15/353; 55/216; 55/218

[58] Field of Search ..... 15/327 C, 320, 321, 15/352, 353; 55/216-218; 137/625.44, 874

[56] References Cited

U.S. PATENT DOCUMENTS

| | | | |
|---|---|---|---|
| 2,586,144 | 2/1952 | Benoit | 137/874 X |
| 2,643,732 | 6/1953 | Keen | 55/216 |
| 3,009,188 | 11/1961 | Martin | 15/352 X |
| 3,331,090 | 7/1967 | Reiber et al. | 15/327 C X |

*Primary Examiner*—Christopher K. Moore
*Attorney, Agent, or Firm*—Alfred E. Miller

[57] ABSTRACT

A dumping system for a wet/dry tank type vacuum cleaner which functions to empty the liquid solution together with the dirt and debris accumulated in the tank. The dumping system is controlled by the operator who can selectively regulate the air flow and thereby control the dumping action of the system. The dirty liquid solution is pumped out of the intake hose of the vacuum cleaner.

7 Claims, 4 Drawing Figures

SUCTION MODE

VACUUM DUMPING ARRANGEMENT FOR A WET/DRY VACUUM CLEANER

This is a continuation, of application Ser. No. 777,959, filed Mar. 16, 1977, and now abandoned.

BACKGROUND OF THE INVENTION

Wet/dry tank type vacuum cleaners are known which are mainly in use in commercial and industrial establishments. These vacuum cleaners are designed to pick up a relatively large amount of liquid by means of a vacuum. However, the dumping of the dirty liquid with its accumulated dirt and debris poses a problem since, in some cases, the cover of the cleaner must be removed and the tank manually lifted and tilted on a sink or basin in order to dump the liquid solution. In other cases, the wet/dry vacuum cleaner is provided with an arrangement for evacuating the liquid solution by means of a separate pump, which is more costly to produce and requires additional maintenance.

It is an object of the present invention to provide a tank type wet/dry vacuum cleaner which is capable of vacuuming dirt laden solutions and pumping the same out of the intake hose.

It is another object of the present invention to provide a tank type wet/dry vacuum cleaner having a built-in valving system for permitting the cleaner to operate in either a suction mode or a dump mode.

It is another object of the present invention to provide a tank type wet/dry vacuum cleaner which is capable of vacuuming dirt and debris as well as liquids and pumping the same out of the intake hose which utilizes a built-in valving system to switch from suction mode to dump mode.

It is another object of the present invention to provide a deflector and flapper valve assembly adjacent to the intake pipe of the wet/dry vacuum cleaner which functions to permit the vacuum cleaner to be changed from suction mode to dump mode and vice versa.

A further feature of the present invention is to provide a tank type wet/dry vacuum cleaner in which the dumping volume is controlled by the operator.

In order that the invention will be more clearly understood, it will now be disclosed in greater detail with reference to the accompanying drawings, in which.

DESCRIPTION OF THE PREFERRED EMBODIMENT

Figure 1:
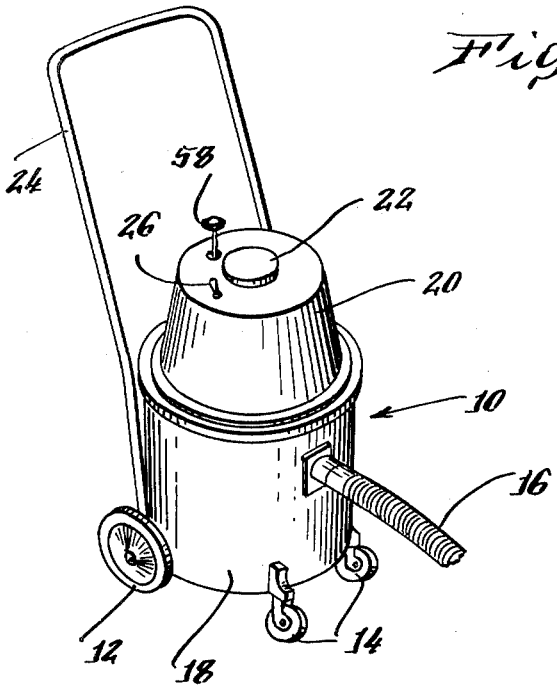
FIG. 1 is a perspective view of a tank type wet/dry vacuum cleaner incorporating the teachings of my present invention.
Figure 2:
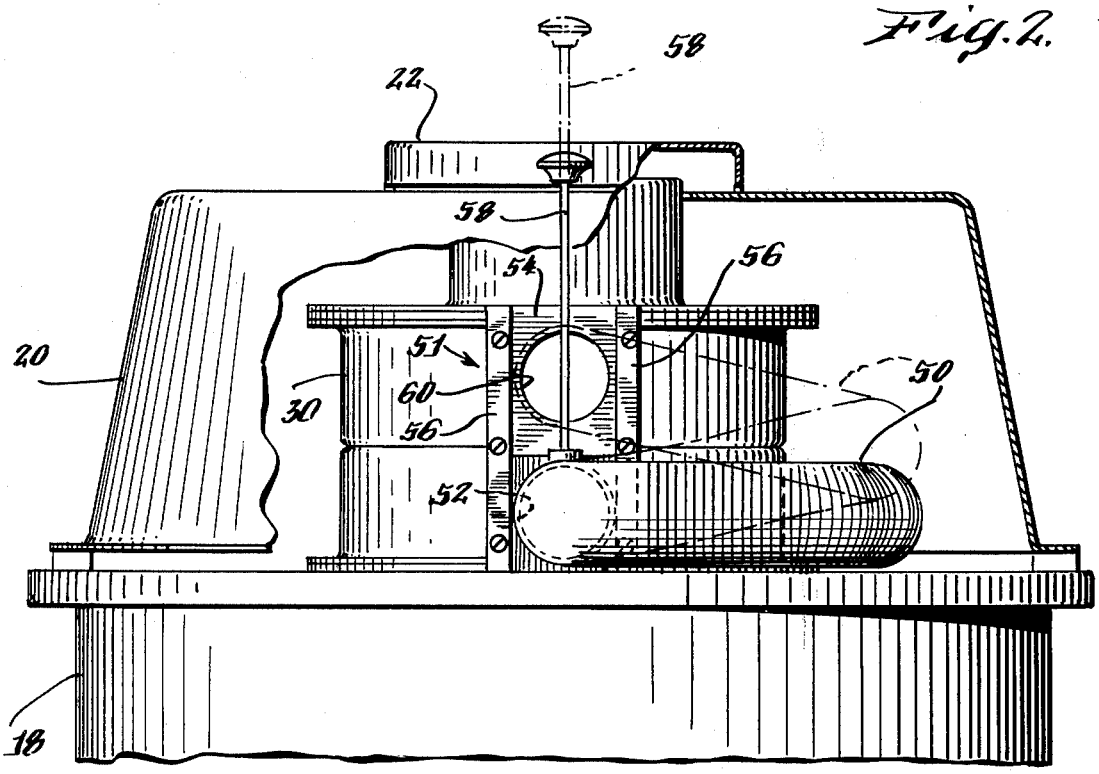
FIG. 2 is an enlarged partial sectional view of the assembly housed under the cover of the vacuum cleaner.

As seen in the figures, a tank type wet/dry vacuum cleaner is shown and is referred to generally by the reference numeral 10, and comprises wheels 12 and castors 14 for mobility. The vacuum cleaner is provided with an intake hose 16, a tank 18, a cover 20, and a cover vent 22. A u-shaped handle 24 is also provided for the device as well as an on-off switch 26.

Figure 3:
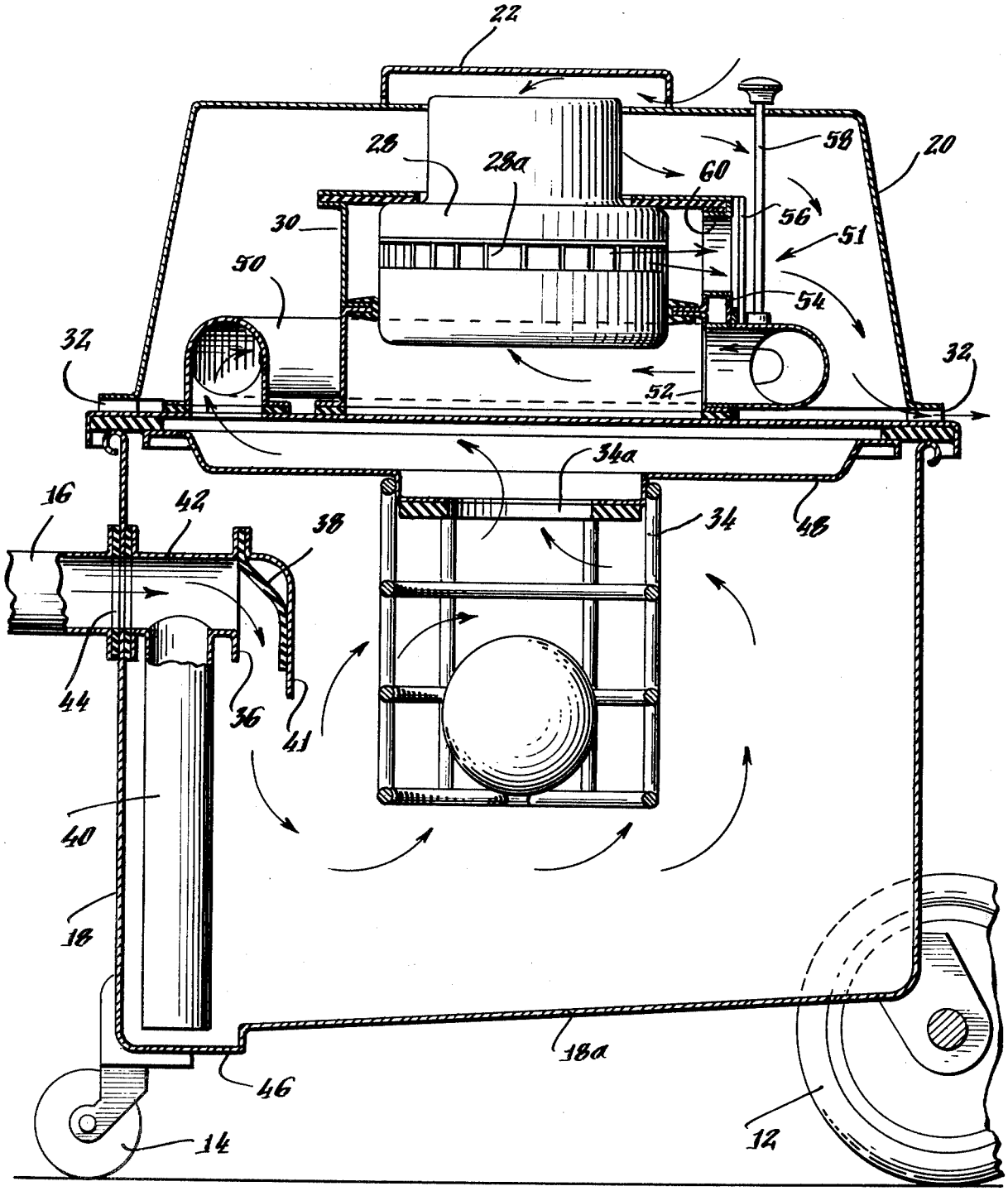
FIG. 3 is a sectional view of the entire unit showing the tank type wet/dry vacuum cleaner in a suction mode.
Figure 4:
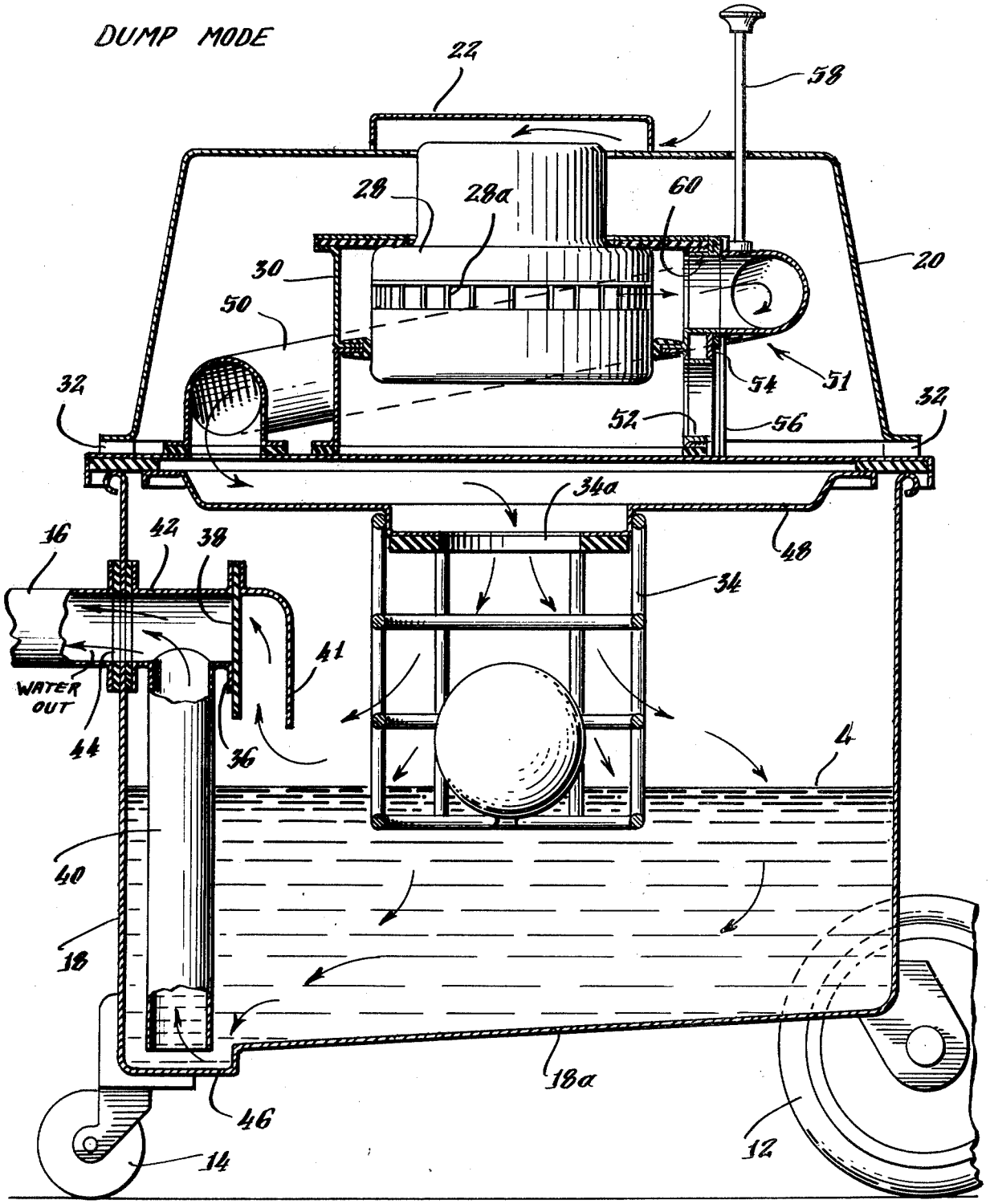
FIG. 4 is a sectional view of the entire unit showing the tank type wet/dry vacuum cleaner in a dump mode.

As seen in FIGS. 3 and 4, a fan motor 28 is provided within its own housing 30, the latter being positioned within the cover 20. The latter is provided with an opening 32 which permits the air present in the space between the housing 30 and the cover 20 to escape to the atmosphere. Moreover, as seen in FIGS. 3 and 4, the tank 18 is provided with a ball shut-off valve 34 as well as a valve 36 having a resilient flap 38 which is referred to as a flapper valve. The ball shut-off valve 34 is shown and described in detail in co-pending U.S. application Ser. No. 730,304 filed Oct. 7, 1976, and entitled FOAM SEPARATOR. Furthermore, a pipe 40 extends vertically within the tank 18 and is connected to a perpendicular conduit 42 that communicates with the opening 44 of the tank as well as the intake hose 16. It will be observed that the bottom of the tank 18 is sloped at **18*a* to a sump 46**. The latter collects liquid which is pumped out of the system when the vacuum cleaner is in the dump mode.

In the normal operation of the wet/dry vacuum cleaner 10, as seen in FIG. 3 and defined as the suction mode, a vacuum is drawn on the intake hose 16 and the air flow is in accordance with the arrows illustrated in FIG. 3. In this condition, the air flows through the intake hose 16 of the vacuum cleaner. The hose 16 is provided with a well-known nozzle or other appliance (not shown) for picking up dirt, debris and/or liquid from floor surfaces. The air flow forces the resilient flap away from the valve seat in order to open the valve 36 permitting the flow of air into the interior of the tank 18. Thereafter, in accordance with the path of the arrows, air passes through an opening **34*a*of the valve 34, through channel 48, flexible tube 50, and through opening 52 in the slide valve assembly referred to generally by the numeral 51. The air flow continues along a path within the motor enclosure 30 and through a portion of the fan motor 28 and out of the vents 28*a* of the fan motor, and finally exits from the space between the motor housing 30 and the cover 20 by means of opening 32 in the cover 20, and thence to the atmosphere. As stated hereinbefore, it will be noted that the air intake forces the resilient flap 38 of the valve 36 to remain open and to permit entry of the air through the short pipe section 41. In this manner dirt, debris and liquid can be drawn into the tank part 18** of the vacuum cleaner.

As seen in the figures, the slide valve 51 is provided with a plate 54 having an opening aligned with the opening of the flexible tube 50 which slides vertically within tracks 56. A control rod 58 is secured to the plate 54 and permits the latter to be slid from the suction mode seen in FIG. 3, to the dump mode seen in FIG. 4, or vice versa. Moreover, the control rod 58 may be manually adjusted to allow the opening of flexible tube 50 on the plate 54 to be somewhat misaligned with the opening 60 in the motor enclosure 30, in order to vary the amount of air flow in the vacuum cleaner, when the latter is in the dump mode likewise, the opening of tube 50 may be somewhat misaligned with opening 52 to vary the airflow when the vacuum cleaner is in the suction mode. Referring further to FIG. 4, the flexible tube 50 communicates the opening 60 with the conduit 48 so that the air flow passing through the vent 22 also passes through a part of the fan-motor 28, flexible tube 50, conduit 48, ball shut-off valve 34, and presses the resilient flap 38 into a sealing position on the valve seat of the valve 36, so that the pressurized air column within the tank forces the liquid L present in the tank 14 up the pipe 40, and out the intake hose 16. Thus, essentially all the liquid together with the accumulated dirt and debris is forced out of the tank 18, thereby evacuating the contents thereof in a dumping action. It should be apparent that by simply moving the control rod 58 to place the plate 54 at a location between the openings 52 and 60, the back pressure within the vacuum cleaner housing is controlled which is directly related to the speed of the dumping operation. The present tank type wet/dry vacuum cleaner in the dump mode will pump the solution to height of approximately 6 feet above the floor level, and the valving system, which is both simple and reliable, permits the rapid changeover of the apparatus from suction mode to dump mode, and vice versa.

What is claimed:

1. A wet/dry vacuum cleaner having a suction mode and a fluid pressurizing mode resulting in air and liquid discharge respectively comprising: a tank provided with an aperture and having an intake hose, a cover for said tank, one end of said hose being connected to said aperture for communication with the interior of said tank, a fan-motor, a separate enclosure for said fan-motor, said enclosure being provided with two spaced openings each of which are fluidly connected to one of the suction or pressure sides of said fan, one of said openings connecting the space between said cover and the enclosure of said fan-motor with the suction side of said fan, a flexible tube communicating said tank with either one of said openings, shifting means for one end of said tube from a connection to one of said openings to a connection to the other of said openings, said flexible tube being continually connected to at least one of said openings, the suction side of said fan having a suction level that can be controlled by misaligning the end of said flexible tube and suction opening to permit air from the space between the cover and enclosure to be bled into said fan, the pressure side of said fan being controlled by misaligning the end of said flexible tube and the discharge opening for controlling the discharge rate of the liquid discharge, said cover spaced from and surrounding said fan-motor enclosure, the latter having said internal space for said fan-motor, said cover also enclosing said shifting means and said flexible tube, vent means in said cover for permitting fluid communication between the atmosphere and said space; the suction mode having air which passes through said flexible tube, through the opening on the suction side of said fan, and through said vent means to the atmosphere; a liquid evacuating means connected to said intake hose, said liquid evacuating means having a pipe provided with one end connected to said intake hose and the other end being free and arranged to be submerged in the liquid solution accumulated in said tank and closely adjacent to the bottom of said tank, a one-way valve in said tank communicating with said intake hose; the fluid pressurizing mode having said flexible tube communicating with the other of said openings whereby air in the space between the cover and enclosure enters the suction side of the fan and passes through the pressure side of said fan, said flexible tube, and to said tank to close said one-way valve thus causing said air in the tank to be pressurized to an extent to pump the liquid solution in said tank out of said pipe and intake hose while said one-way valve is maintained in the closed condition.

2. A wet/dry vacuum cleaner as claimed in claim 1 wherein said means for shifting said flexible tube from one opening to the other opening is a slidable plate mounting said one end of said tube and having an aperture aligned with the opening of said tube, said plate aperture being slidable between positions in alignment with either of said openings.

3. A wet/dry vacuum cleaner as claimed in claim 2 wherein said shifting means includes a control rod connected to said slidable plate, the free end of said control rod extending externally of the vacuum cleaner cover and adapted to be operated manually.

4. A wet/dry vacuum cleaner as claimed in claim 3 wherein said slidable plate and control rod operate in a vertical plane whereby said control rod projects above the top of said cover.

5. A wet/dry vacuum cleaner as claimed in claim 1 wherein said one-way valve is a flexible flapper valve whereby the suction present in the tank will maintain the flapper valve in an open condition permitting dirt, debris and liquid to be drawn into said tube.

6. A wet/dry vacuum cleaner as claimed in claim 1 further comprising a sump in the bottom of said tank, said pipe being vertically disposed and communicating with said intake hose at one end thereof and extending into said sump at the other end thereof whereby when said one-way valve is closed and said vacuum cleaner is in the pressurized mode the liquid solution is substantially completely evacuated from said tank.

7. A wet/dry vacuum cleaner as claimed in claim 1 further comprising an automatic float type shut-off means in the tank which eliminates the vacuum cleaner suction when the liquid level in the tank rises to a predetermined level.

* * * * *